United States Patent [19]

Schechter

[11] Patent Number: 4,498,625

[45] Date of Patent: Feb. 12, 1985

[54] ELECTROMAGNETIC UNIT FUEL INJECTOR AND METHOD FOR CALIBRATING

[75] Inventor: Michael M. Schechter, Southfield, Mich.

[73] Assignee: Ford Motor Company, Dearborn, Mich.

[21] Appl. No.: 508,398

[22] Filed: Jun. 27, 1983

[51] Int. Cl.[3] ..... F02M 45/00

[52] U.S. Cl. ..... 239/5; 239/88; 239/124; 403/47

[58] Field of Search ..... 285/175; 239/588–592, 239/95, 124, 125, 585; 403/47

[56] References Cited

U.S. PATENT DOCUMENTS

| | | | |
|---|---|---|---|
| 1,242,066 | 10/1917 | Starr | 403/47 |
| 2,444,666 | 7/1948 | Orain | 403/47 |
| 3,263,645 | 8/1966 | Hansel | 285/175 X |
| 4,408,718 | 10/1983 | Wich | 239/585 X |

FOREIGN PATENT DOCUMENTS

| | | | |
|---|---|---|---|
| 2098673 | 11/1982 | United Kingdom | 239/92 |

*Primary Examiner*—Andres Kashnikow

*Attorney, Agent, or Firm*—Peter Abolins; Robert D. Sanborn

[57] ABSTRACT

A unit fuel injector combines an injection nozzle, a fuel pumping unit, and a solenoid valve with a mechanism for precise adjustment of the air gap size in the solenoid. Activation of the solenoid and closing of the spill port in the solenoid valve results in fuel injection from the injection nozzle. Controlling the duration and timing of the solenoid voltage pulse controls the quantity of fuel injected and injection timing, while an adjustment of the size of the solenoid air gap permits fine adjustment of the quantity of fuel injected at a given voltage pulse duration. Adjustment of the air gap size in the solenoid for the unit fuel injector uses a differential thread arrangement. Relative rotation takes place between two pairs of threads so that the accuracy of adjustment is determined by the difference between the pitches of the two pairs of threads.

10 Claims, 3 Drawing Figures

ELECTROMAGNETIC UNIT FUEL INJECTOR AND METHOD FOR CALIBRATING

BACKGROUND OF THE INVENTION

1. Field of the Invention

This invention relates to unit fuel injectors for internal combustion engines and, in particular, to an electromagnetic unit fuel injector.

2. Prior Art

There are known fuel injection systems wherein the fuel metering and the injection timing occurs by solenoid valves controlling the timing of spill ports closing and opening. One of the difficulties associated with such systems is related to solenoid-to-solenoid scatter in activation and deactivation delays. This leads to unequal duration of closed spill ports in different solenoid valves and may result in poor port-to-port fuel distribution. The higher the injection rate, the more pronounced is this effect on fuel distribution. Since diesel engines utilize high fuel injection rates, application of such an electromagnetic fuel injection to diesels is particularly difficult.

An important item in such a fuel injection system is a solenoid valve in which the air gap between the solenoid core and the armature can be adjusted. A change in the air gap has a pronounced effect on both the activation time and the deactivation time. An increase in the air gap increases the activation time, due to a reduction in the magnitude of the initial magnetic force and an increase in the valve travel distance. It also decreases the deactivation time, due to reduced residual magnetism. Since the valve closed duration is determined by the duration of the solenoid activation pulse less the activation time and plus the deactivation time, an increase in the air gap leads to a decrease in the valve closed duration and, thus, decreases the fuel delivery. Conversely, a decrease in the air gap increases the fuel delivery. With sufficiently fine and precise means of air gap adjustment, the solenoid valves can be calibrated to a specified fuel delivery at a given duration of solenoid activation pulse with high degree of accuracy.

A conventional single thread adjustment is a most widely used devices for adjusting the air gaps in solenoids. The accuracy with which such an adjustment can be performed depends on the pitch of the thread which, due to physical limitations, cannot be made excessively fine.

U.S. Pat. No. 4,232,830 to Casey et al teaches a solenoid valve structure which includes an adjustment screw threaded into an internal bore of a core member to provide adjustment of the valve closure force by means of a pin moving against a spherical ball member. The core member is in turn provided with a threaded end which threads into the rear end cap. The outer thread of the core member serves to adjust the air gap. The adjustment screw provides adjustment of the valve closure force. As a result, these two threads perform two distinctly different adjustments which are not and cannot be performed simultaneously.

U.S. Pat. No. 3,797,756 to Voit et al teaches an electromagnetically actuated fuel injector valve for use with diesel engines. Two threads are also taught in this patent but neither of the two threads is used for adjustments. An outer thread is used for fastening purposes. It helps to secure two parts together by a nut. The inner thread in the bore in the part having an outer thread serves for connection to a return line.

U.S. Pat. No. 3,596,507 to Oshima et al teaches a double-threaded screw arrangement. However, the double threads are not used in combination to provide an adjustment. The thread on one screw is used to adjust the preload of a spring. The outer thread on the part receiving the screw serves to fasten this part to the injector.

The above cited prior art teaches conventional single thread mechanisms each acting individually to perform an adjustment function. It would be desirable to obtain an exceptionally fine adjustment in fuel injectors, typically unattainable with conventional single thread mechanisms.

SUMMARY OF THE DISCLOSURE

This disclosure describes a unit fuel injector having an injection nozzle, a cam actuated plunger-type pumping unit, and a solenoid valve, with a mechanism for precise adjustment of an air gap associated with the solenoid. The solenoid valve is activated once every plunger pumping stroke, closing a normally open spill port for a short period of time, and is deactivated, opening the spill port before the end of the plunger pumping stroke. As long as the spill port is open, fuel displaced by the plunger escapes from the plunger barrel. Closing the spill port traps fuel in the plunger barrel. For the duration of the spill port closure, fuel displaced by the plunger is injected through the nozzle. Controlling the duration and timing of the spill port closure controls the quantity of fuel injected and the injection timing. An adjustment of the size of the solenoid air gap permits fine adjustment of the quantity of fuel injected so that each unit injector can be precision calibrated to deliver a specified quantity of fuel in response to a voltage pulse of specified duration.

In particular, this invention teaches the very fine adjustment of the size of an air gap in a unit fuel injector solenoid using a differential thread adjusting mechanism wherein relative rotation takes place in each of two pairs of threads simultaneously. The accuracy of adjustment is determined by the difference of the pitches between the two pairs of threads. This differential can be very small even if the threads of each pair are relatively coarse and, thus, an exceptionally fine adjustment, unattainable with a single thread pair mechanism, can be achieved.

DETAILED DESCRIPTION OF THE INVENTION

Figure 1:
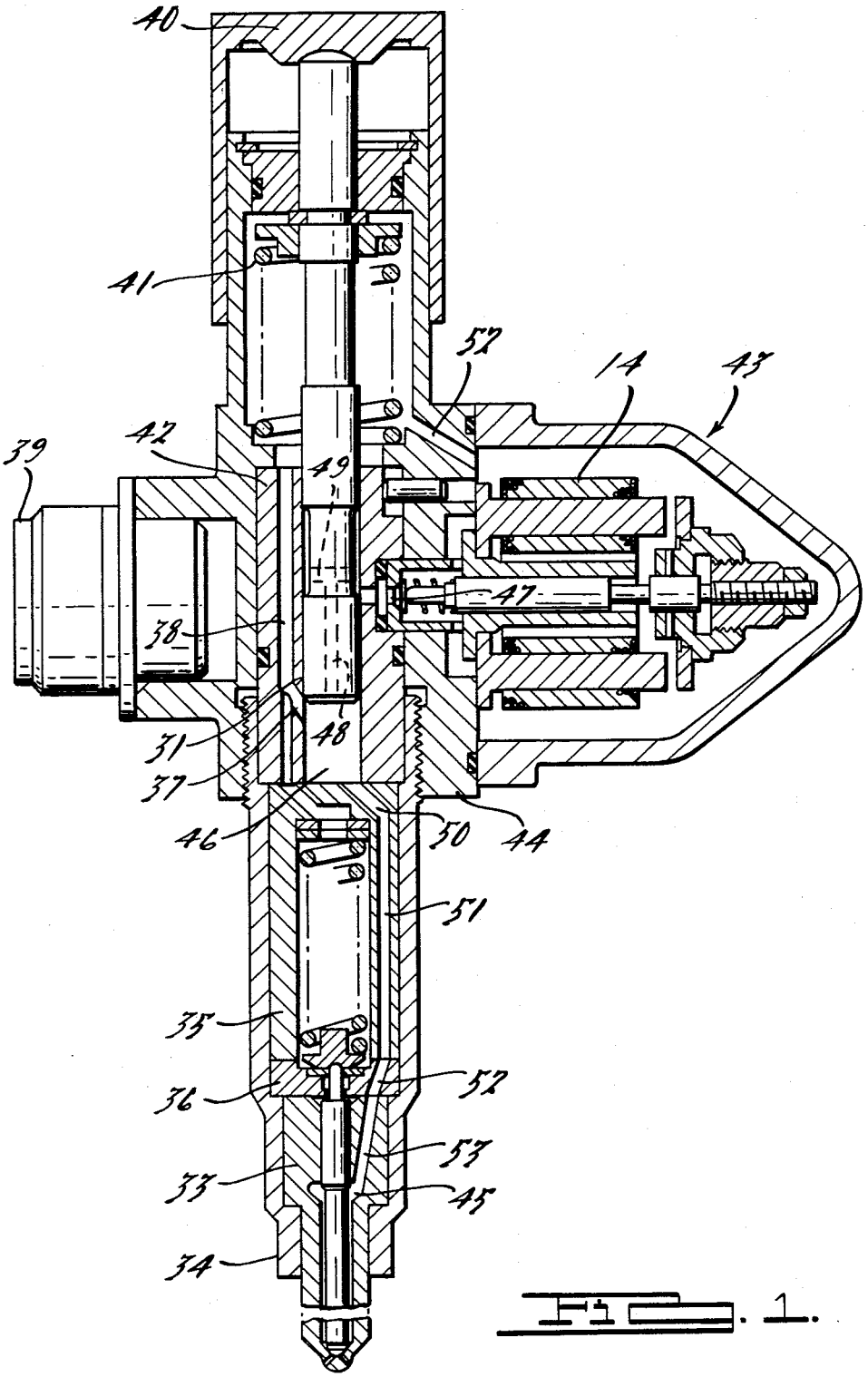
FIG. 1 is a cross section view of a unit fuel injector in accordance with an embodiment of this invention.

Referring to FIG. 1, a nozzle holder 34 contains a conventional diesel nozzle assembly 33, nozzle spring assembly 35, and a transfer body 36. The pump holder 44 contains a pump assembly consisting essentially of a plunger 31, a plunger barrel 42, and a return spring 41. A solenoid valve assembly 43 is attached to the side of pump holder 44. The plunger is driven by a cam acting on the tappet 40. The fuel is delivered under low supply pressure through an inlet fitting (not shown in the drawing) into the return spring chamber and from there follows through a channel 52 to the solenoid assembly and through a channel 38 and fill port 37 into the plunger barrel chamber 46. Internal passages 48 and 49 in plunger 31 and an annulus machined on its outer surface connect a chamber 46 with a spill port 47. Fitting 39 is an external electric connector from which internal wiring leads to solenoid coils 14 of solenoid valve assembly 43.

During the upward stroke of plunger 31, chamber 46 is filled with fuel which enters through both a fill port 37 and spill port 47. Fill port 37 is closed off by plunger 31 in the early stage of its downward stroke but the fuel can still escape from chamber 46 through spill port 47, as long as the solenoid valve remains in open position. When the solenoid is activated, spill port 47 is closed and the fuel trapped in chamber 46 is pumped through channels 50 and 51 in nozzle spring assembly 35, channel 52 in transfer body 36, and channel 53 in nozzle assembly 33 to a pressure chamber 45. The rising fuel pressure opens a nozzle valve and the fuel injection begins. When the solenoid is deactivated, spill port 47 opens and the fuel can escape from chamber 46. The fuel pressure in pressure chamber 45 drops and the nozzle valve closes, thus terminating the fuel injection. Voltage pulses at variable and controllable duration and timing supplied by an outside electronic control system are used to activate the solenoid. Controlling the duration and timing of the solenoid activation pulse controls the fuel delivery and injection timing. Fine adjustment of the quantity of fuel injected without change in the voltage pulse duration can be achieved by adjustment of an air gap 75 in solenoid valve assembly 43.

Figures 2, 3:
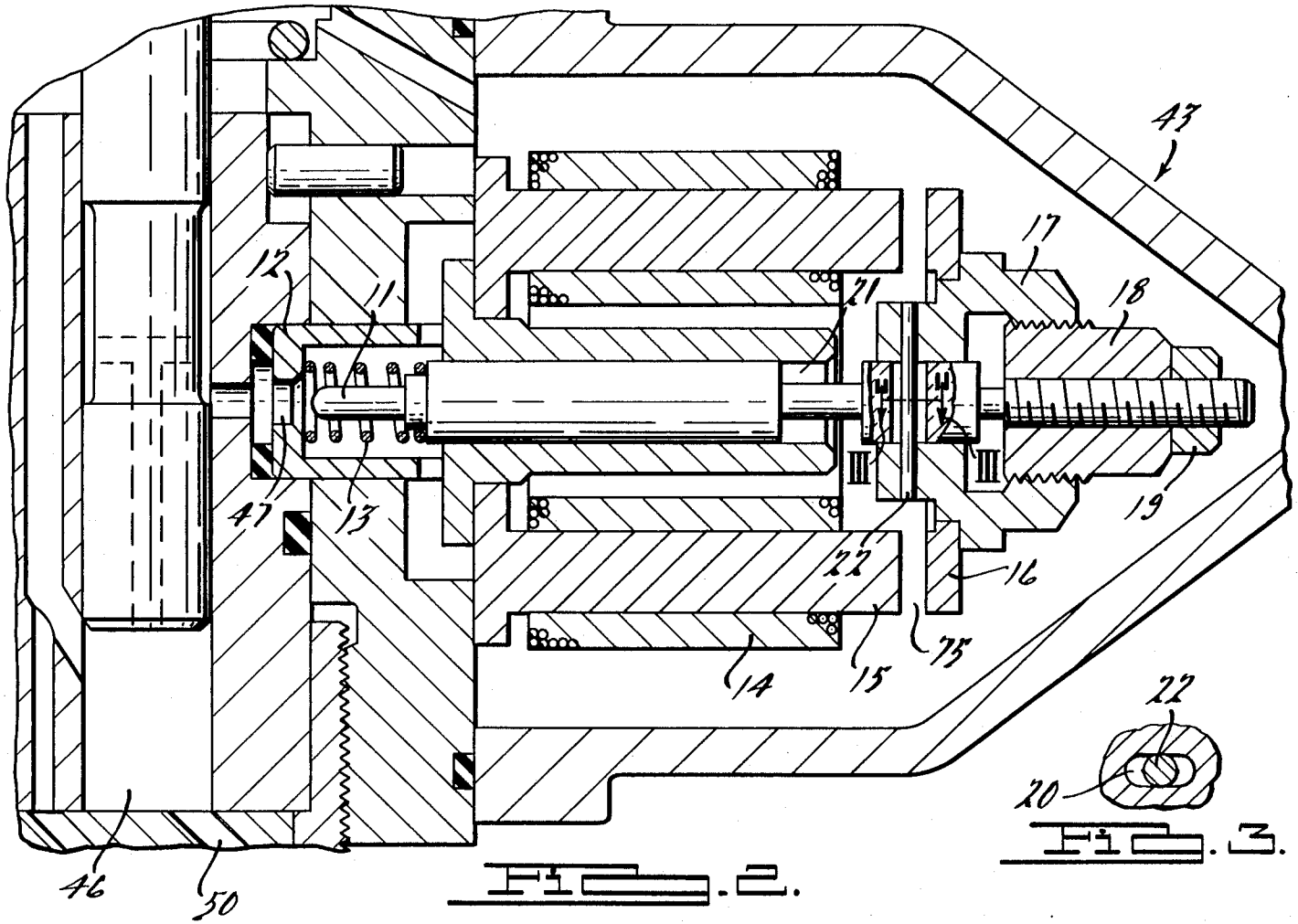
FIG. 2 is an enlargement of a portion of FIG. 1 including a differential thread adjusting mechanism in accordance with an embodiment of this invention.
FIG. 3 is a section view along line III—III of FIG. 2 including a pin which is rotationally fixed and longitudinally moveable with respect to another member.

Referring to FIG. 2, solenoid valve assembly 43 includes a solenoid core 15 with solenoid coils 14, a solenoid armature 16 welded to a non-magnetic hub 17, valve 11, and a valve body 12. Air gap 75 is bounded by solenoid core 15 and solenoid armature 16. A spring 13 tends to keep the valve 11 in normally open position, pressed against a permanent stop 21. In this position, an air gap exists between armature 16 and core 15. When the solenoid is activated, a magnetic traction force pulls armature 16 towards solenoid core 15 until valve 11 closes a spill port 47.

Armature hub 17 is connected to valve 11 by means of a pin 22 and a calibration nut 18. Pin 22 is press fitted into a corresponding round hole in hub 17 and goes through an elongated slot 20 in valve 11 (FIG. 3). Thus, pin 22 prevents rotation of hub 17 relative to valve 11 but does not preclude a change in their relative axial positions. Other components such as a key, can be used instead of the pin 22 for the same purpose. Calibration nut 18 is screwed on valve 11 and into hub 17. There is a slight difference in the number of threads per inch in the pair of threads associated with the inside of calibration nut 18 and the pair of threads associated with the outside of calibration nut 18. This assures that, when nut 18 is turned relative to hub 17, there is a slight difference in the resulting axial movements of hub 17 and valve 11. The change in the air gap is equal to this differential.

For example, if one of the threads has 40 threads per inch and the other 44, one full turn of the calibration nut 18 changes the air gap 1/40–1/44 inch=0.00227 inch=0.058 millimeter. Thus a turn of approximately 6° will change the air gap one micrometer. A concentric tool consisting of two coaxial sockets for engagement with, and providing relative rotation of, hub 17 and nut 18, and incorporating a protractor can be used for very fine and precise adjustment of the air gap. A jam nut 19 is tighted after the adjustment is completed.

The solenoid force required to keep the valve closed is determined by the valve gauge diameter and the pressure inside the pump during the injection. With very high fuel injection pressures used in some diesel engines, the magnitude of the required force may be substantial. To eliminate the need for excessively high solenoid force, other types of valves can be used. For example, in a spool-type valve, the solenoid has to overcome only the force of the return spring in order to keep the valve closed.

Various modifications and variations will no doubt occur to those skilled in the various arts to which this invention pertains. For example, the particular positioning of the differential thread adjustment with respect to the remainder of the fuel injector may be varied from that disclosed herein. These and all other variations which basically rely on the teachings through which this disclosure has advanced the art are properly considered within the scope of this invention.

I claim:

1. An electromagnetic unit fuel injector having a solenoid valve; an injector nozzle; a cam actuated plunger type pumping unit with a spill port adapted to be closed and opened by the action of the solenoid valve during a plunger pumping stroke, the spill port permitting fuel to enter and escape from the pumping unit when the spill port is open and preventing the escape of fuel from the pumping unit when the spill port is closed; the solenoid valve being adapted to receive voltage pulses of variable and controllable duration and timing, the voltage pulse duration and timing controlling the duration and timing of the spill port closing, the duration of the spill port closing controlling the quantity of fuel injected and the timing of the spill port closing controlling the fuel injection timing; the solenoid valve having a mechanism for adjustment of a solenoid air gap associated with the solenoid valve, said mechanism including:

a differential thread arrangment having two pairs of threads so that relative rotation can take place between two threads of each of said two pairs of threads simultaneously and the accuracy of adjustment is determined by the difference between the pitches of said two pairs of threads, so that fine adjustment of the solenoid air gap provides fine adjustment of the quantity of fuel injected without change in the voltage pulse duration.

2. An electromagnetic unit fuel injector as recited in claim 1, wherein:

said diffetential thread arrangement is a concentric arrangement having a first axial member, a second axial member concentric about said first axial member, and a third axial member concentric about said second and first axial members, a first pair of threads including said first and second axial members and a second pair of threads including said second and third axial members.

3. An electromagnetic unit fuel injector as recited in claim 2, wherein:

said second axial member is rotationally movable with respect to said first and third axial members and said first and third axial members are rotationally substantially fixed with respect to each other.

4. An electromagnetic unit fuel injector as recited in claim 3, wherein:

said first and second axial members have a thread pitch coupling them which is not equal to a thread pitch coupling the third and second axial members.

5. An electromagnetic unit fuel injector as recited in claim 4, wherein:

said first and third axial members have a pin means coupling them for preventing relative rotational movement while permitting relative axial movement.

6. An electromagnetic unit fuel injector as recited in claim 5, wherein:

said first axial member has an opening therethrough for receiving said pin means, said opening having an axial dimension greater than the axial dimension of said pin in the direction of elongation of said first axial member.

7. A method for calibrating a fuel injection solenoid by adjusting the air gap between the solenoid core and the armature including the steps of:

coupling a first member defining a boundary of the air gap to a first axial member;

coupling a second member defining a boundary of said air gap to a third axial member; and coupling said first and third axial members to each other by a second axial member, the coupling between the first and second axial members, and the coupling between the second and third axial members having a different thread pitch so that the difference in thread pitches determines the rate of adjustment of the magnitude of the air gap.

8. A method as recited in claim 7 wherein:

said second axial member is concentrically mounted on said first axial member and said third axial member is concentrically mounted on said second axial member.

9. A method as recited in claim 8 further comprising:

preventing relative rotational movement between the first and third axial members while permitting axial movement between the first and third axial members.

10. A method as recited in claim 9 wherein:

rotating said second axial member relative to said first and third axial members causes axial movement between said first and third axial members, thereby adjusting the air gap between the solenoid core and the armature and adjusting the quantity of fuel injected by the fuel injection solenoid without changing the voltage pulse duration applied to the fuel injection solenoid.

* * * * *